United States Patent [19]

Cheng

[11] Patent Number: 5,040,253

[45] Date of Patent: Aug. 20, 1991

[54] VARIABLE BED HAVING MULTIPLE FUNCTIONS

[76] Inventor: Yen-Feng Cheng, 5F, No. 64 Chien-Kang St., Shih-Lin Districe, Taipei, Taiwan

[21] Appl. No.: 552,496

[22] Filed: Jul. 16, 1990

[51] Int. Cl.[5] ..... A61G 7/06

[52] U.S. Cl. ..... 5/66; 5/67; 5/76

[58] Field of Search ..... 5/60, 66, 67, 81 B, 5/83, 76

[56] References Cited

U.S. PATENT DOCUMENTS

| | | | |
|---|---|---|---|
| 25,766 | 10/1859 | Sheidley | 5/66 |
| 638,755 | 12/1899 | Piper et al. | 5/83 |
| 704,625 | 7/1902 | Fox | 5/83 |
| 805,805 | 11/1905 | Loose | 5/66 |
| 1,630,453 | 5/1927 | Smith | 5/76 |
| 3,693,200 | 9/1972 | Stafford | 5/66 X |
| 4,675,926 | 6/1987 | Lindblom et al. | 5/60 X |
| 4,787,104 | 11/1988 | Grantham | 5/66 |

*Primary Examiner*—Michael F. Trettel

[57] ABSTRACT

A variable bed includes a foldable bed having a plurality of bed units pivotally joined with one another normally lying on a bed frame positioned under the foldable bed; a central jack capable of raising a bed unit of a back portion of the foldable bed for forming a reclining bed or a folding chair on the frame; two end jacks for raising a head portion and a foot portion of the bed for forming a concave bed or for suspending the bed above the frame for serving as a hammock; and a driving motor as controlled by several clutches for driving the jacks or for moving the bed units frontwardly for converting a reclining bed to a folding chair to allow several front bed units to be pendant on a front end wall of the bed frame.

10 Claims, 6 Drawing Sheets

VARIABLE BED HAVING MULTIPLE FUNCTIONS

BACKGROUND OF THE INVENTION

A conventional bed is always made as a fixed type, which is not suitable for resuscitation or leisure purposes. A hospital bed may be adjusted to obtain its leaning positioning such as for lifting a patient's head or feet. However, the hospital bed can not serve as a hammock for leisure purpose. The conventional (hospital) bed is manually adjusted to a fixed leaning angle, not suitable for excercise or resuscitation use. If for meeting the requirement of plural resuscitation and leisure movements, several kinds of beds or chairs should be provided which can increase installation cost and may occupy a large space, especially not allowed in an apartment in a crowded city.

It is therefore expected to invent a variable bed having multiple functions for resuscitation or leisure purposes.

SUMMARY OF THE INVENTION

The object of the present invention is to provide a bed which can be adjusted to be a flat bed, a reclining bed, a folding chair, a concave bed with two end portions inclined upwardly, and a hammock for physical resuscitation or leisure purposes by selectively depressing a switch button for any desired bed positioning and movement.

DETAILED DESCRIPTION

Figure 1:
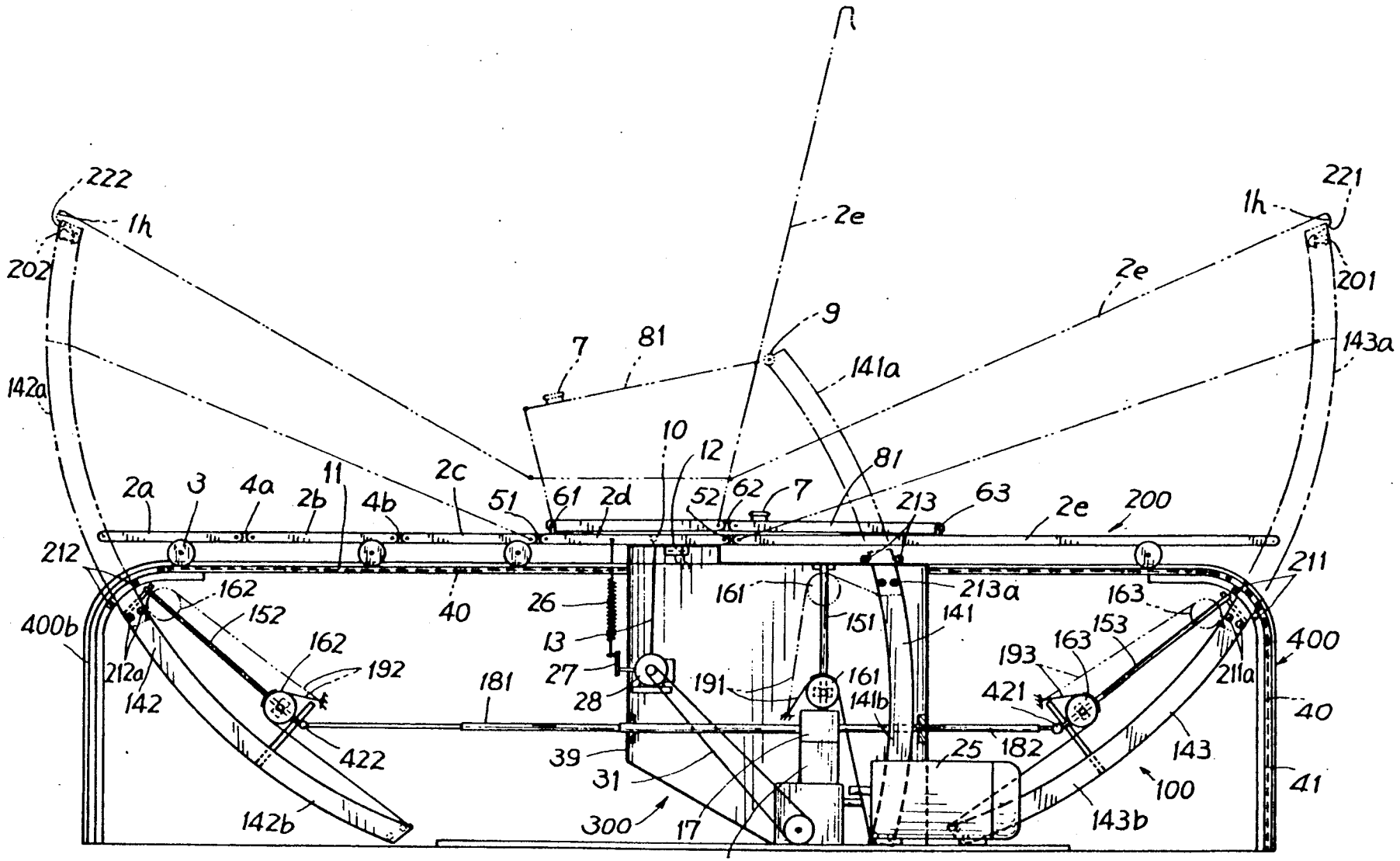
FIG. 1 is a front view illustration of the present invention.

The present invention comprises: a lifting means 100 including a plurality of arcuate jacks 141, 142, 143; a foldable bed 200 comprised of a plurality of foldable linked bed units 2*a*, 2*b*, 2*c*, 2*d*, 2*e*; a driving means 300 and a bed frame 400 for supporting the bed 200 thereon and for encasing the driving means 300 therein. The bed 200 may be upholstered for comfortable lying or seating use.

Figure 4:
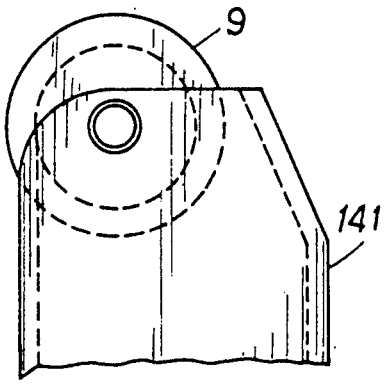
FIG. 4 shows an upper portion of a central jack of the present invention.
Figure 4A:
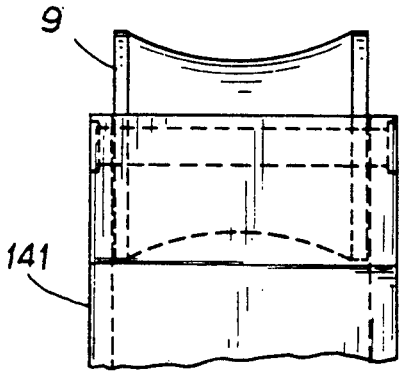
FIG. 4*a* is a side view of FIG. 4.
Figure 6:
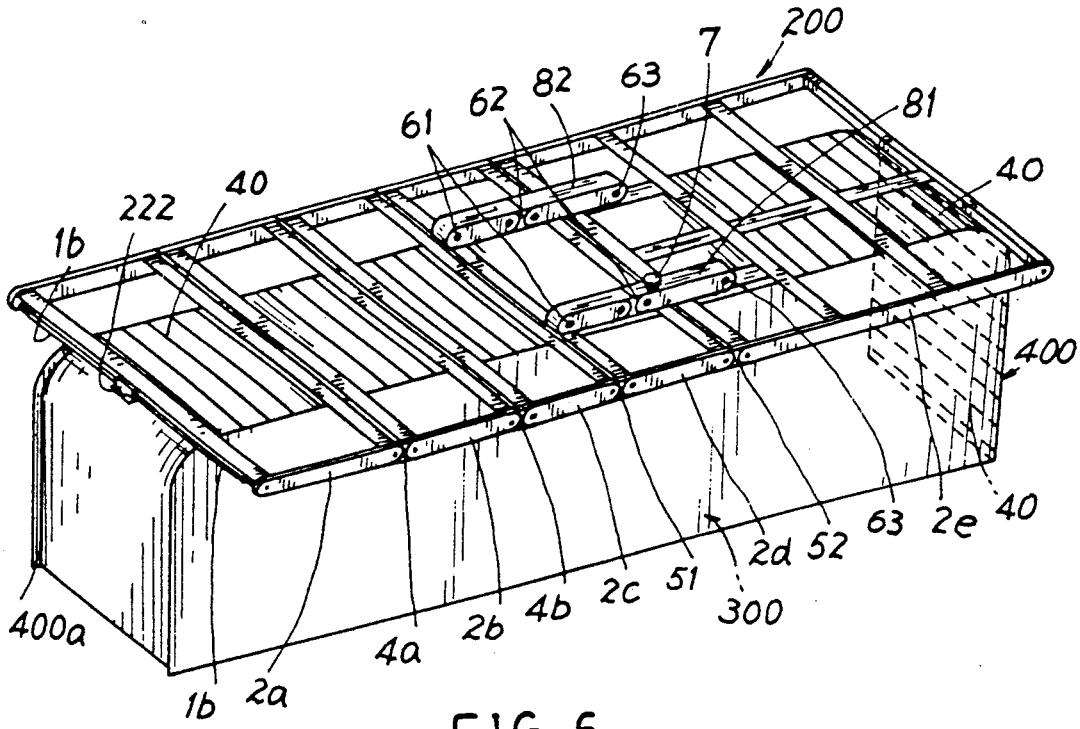
FIG. 6 shows a flat bed in accordance with the present invention.
Figure 7:
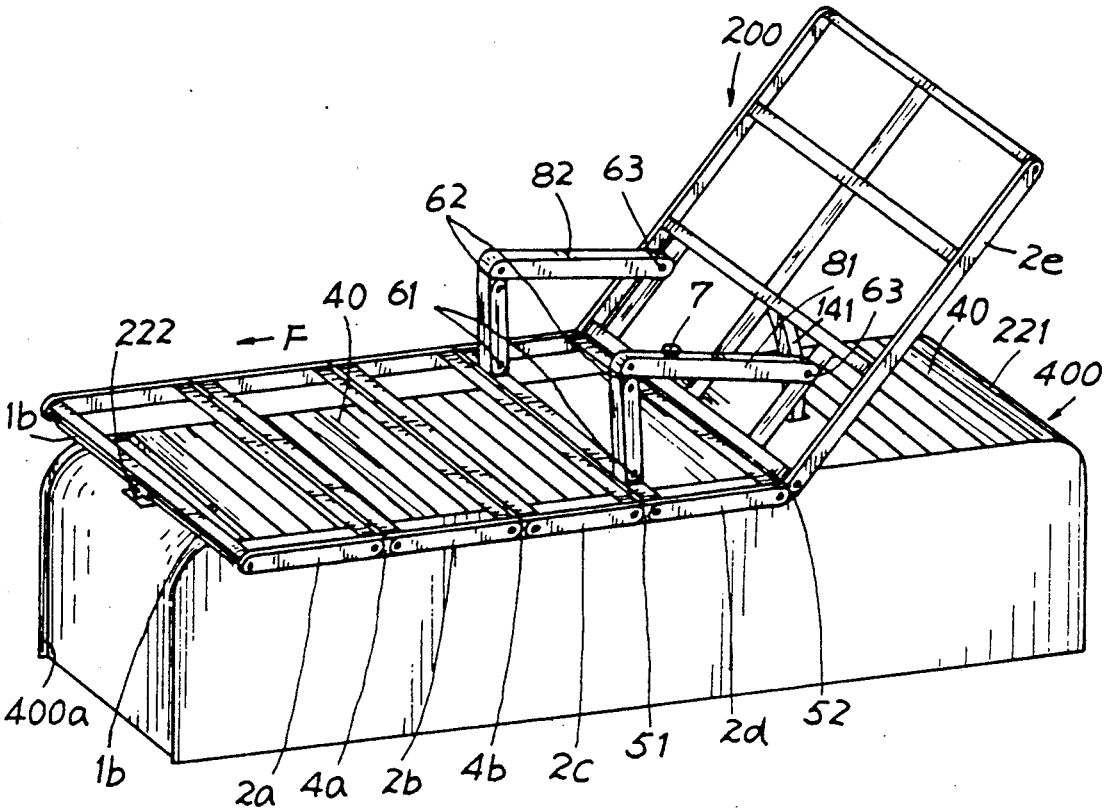
FIG. 7 shows a reclining bed of the present invention.

As shown in FIGS. 6, 7, when it is intended to variate the flat bed as shown in FIG. 6 to be a reclining bed as shown in FIG. 7, a selector switch button 7 is actuated by rotating the button 7 to a position having a marking of "reclining bed" to issue a signal to a clutch controller 24 of a central arcuate jack 141 for coupling clutch 23 with a driving motor 25 for rotating a worm and gear 151 for raising a pulley 161. A drafting wire 191 is wound on the pulley 161 having its one end of the wire 191 secured to a fixed portion of a housing 39 of the driving means 300 and having the other end of the wire 191 secured to a bottom portion of a crank shaft 141*a* of the central arcuate jack 141. The rising of the pulley 161 will raise the crank shaft 141*a* movably held in a jack sleeve 141*b* having a longitudinal slot (not shown) formed in the sleeve 141*b* for the movement of the wire 191 to allow a contact roller 9 pivotally formed on a top portion of the jack 141 (FIG. 4) to raise a back portion bed unit 2*e* of the foldable bed 2 about a pivot 52 for an upward movement of the bed unit 2*c*. A pair of armrests 81, 82 are pivotally connected to the bed 200 by forming a parallelogram linkage and are raised by pivotting the linkage about the pivots 61, 62, 63 and 52 as shown in FIG. 7. When the back portion unit 2*e* is raised to a leaning angle about 75 degrees, the power is switched off to form a reclining bed as shown in FIG. 7. By rotating the switch button 7 to a positive having a "flat bed" marking, the above-mentioned operation is reversed to lay down the bed 200 on the frame 400.

When raising the central jack 141, a pair of guide rollers 213 are formed in an upper opening of the jack sleeve 141*b* for guiding the jack 141.

Figure 1A:
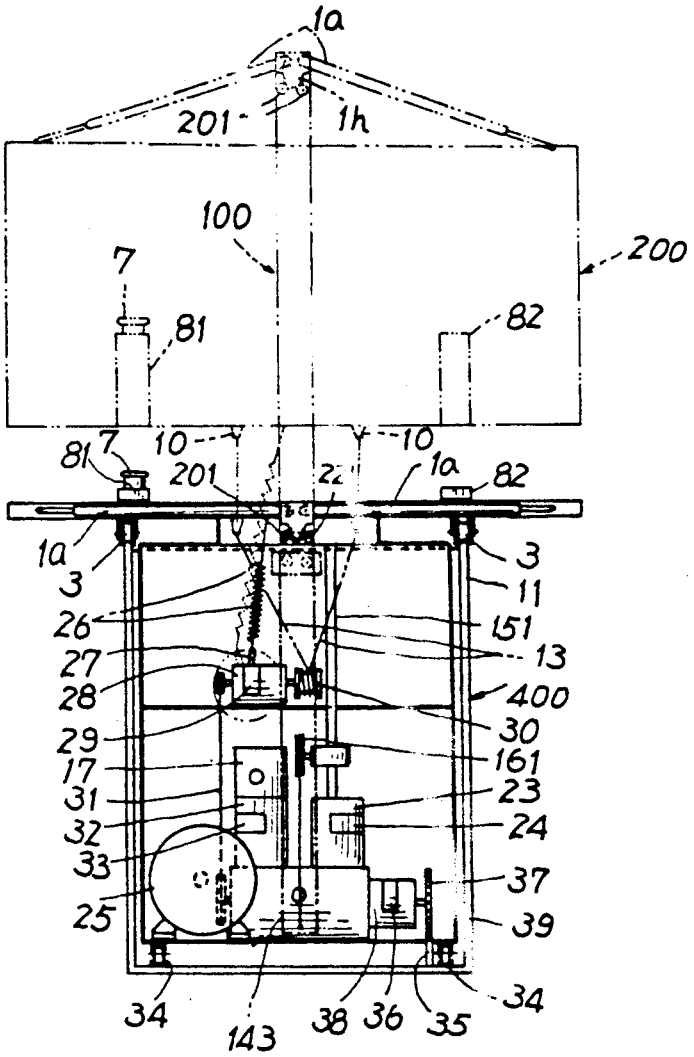
FIG. 1*a* is a side view of the present invention.
Figure 8:
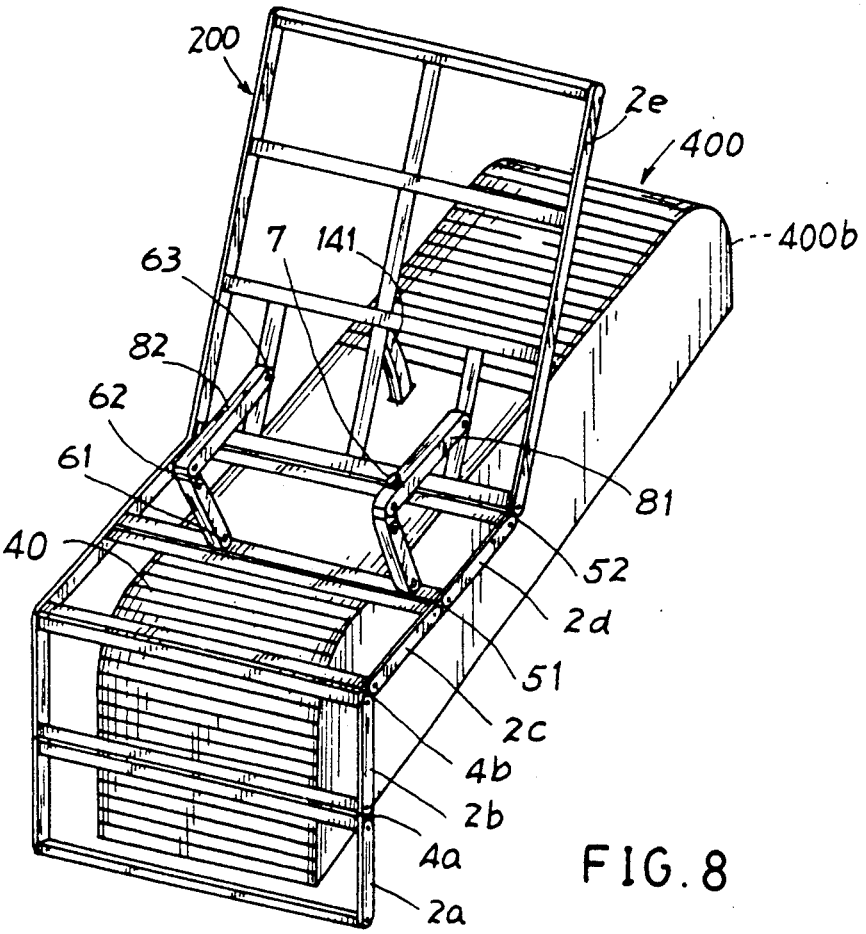
FIG. 8 shows an upstanding folding chair of the present invention.

When it is required to pose an upstanding folding chair as shown in FIG. 8, the switch button 7 is selectively rotated to a marking of "folding chair" to transmit a signal to the clutch controller 24 to form the reclining bed as above-mentioned. Then the clutch controller 24 is actuated to give an instruction to stop the operation of the clutch 23 and initiate a clutch controller 36 of a forwarding clutch 38 to start a forwarding operation of the driving means 300 to rotatably drive at least a forwarding wheel 37 on a wheel rail 35 formed on a bottom of the frame 400 as shown in FIG. 1*a*. The driving means 300 may also be provided with other supporting rollers rotatably running on at least a roller rail 34 formed on the bottom of frame 400. Since the central jack 141 is mounted in a housing 39 which may be insulated for preventing noise pollution from the movable driving means 300, the bed 200 is pushed frontwardly in an arrow direction F as shown in FIG. 7 by rotatably running the rollers 3 on the frame 400 to allow the first and second bed units 2*a*, 2*b* to be pendant on a front vertical wall of the frame 400. Two pivots 4*a*, 4*b* are provided for a downward movement of the bed units 2*a*, 2*b* for helping such a pendant movement of bed units 2*a*, 2*b*. A front telescopic transmission shaft 181 is retracted and a rear telescopic transmission shaft 182 is extended during the forwarding of the driving means 300, whereas louvers 40 adapted for shielding the driving means 300 and frame 400 slidably held in guide grooves 41 are pushed frontwardly to shield the front recess 400*a*, while leaving a rear recess 400*b* not shielded. After positioning the upright folding chair shown in FIG. 8, the power will be automatically switched off, thereby serving a sofa for comfortable seating. By depressing the button for reversing the above-mentioned steps, the "chair" can then be returned to its original status to be a flat bed.

Figure 3:
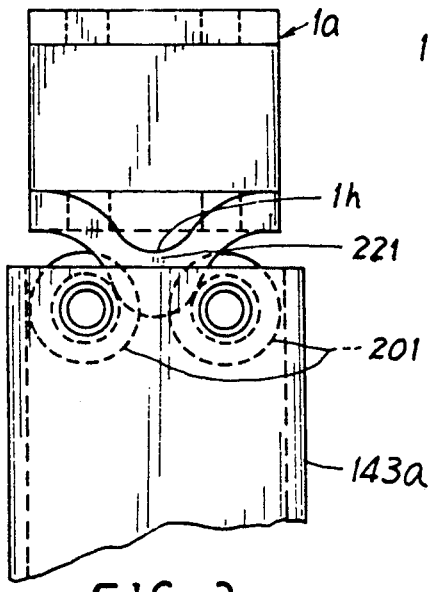
FIG. 3 shows an engagement of an arcuate hook portion of the telescopic rod means with a pair of supporting and pivoting rollers of the present invention.
Figure 3A:
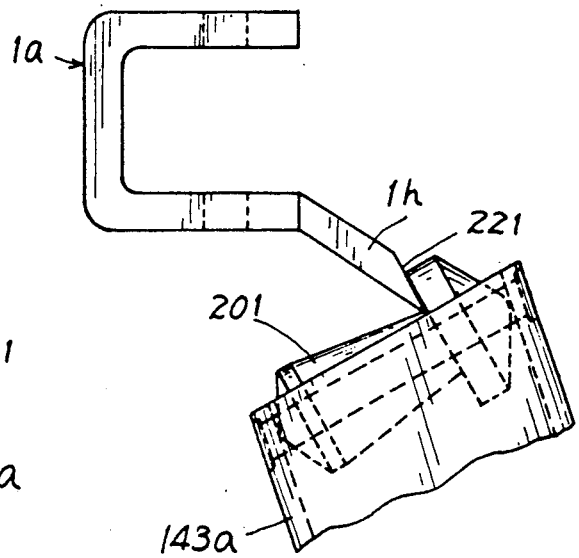
FIG. 3*a* is a side view of FIG. 3.
Figure 9:
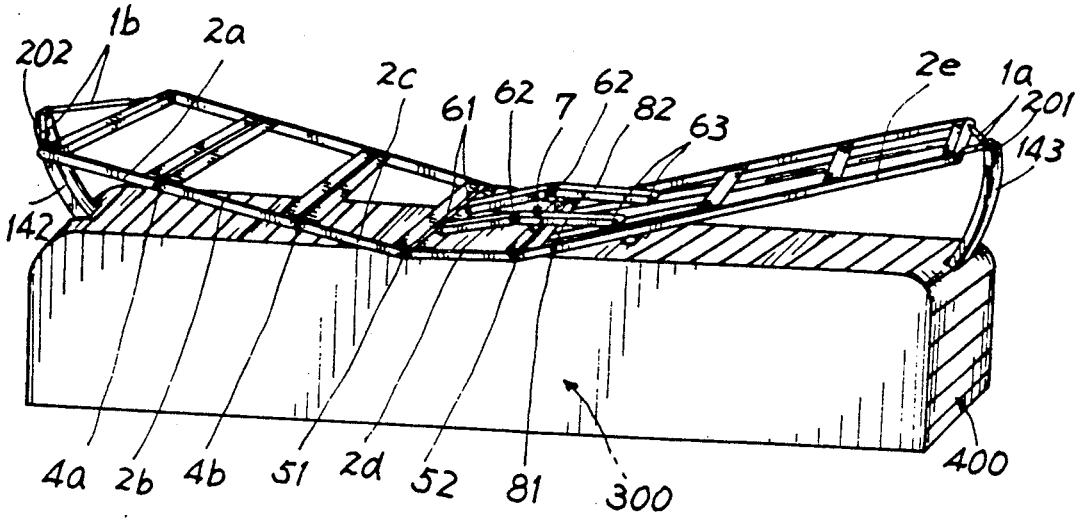
FIG. 9 shows a concave bed of the present invention.

For positioning a concave bed as shown in FIG. 9, the switch button 7 should be first rotated to the marking of "flat " to flatten the bed 200 and then rotated to a marking of "concave bed" to transmit a signal to a clutch controller 33 and clutch 32 for driving a directional bearing 17, telescopic transmission shafts 181, 182, dynamic transmission joints 421, 422 so as for rotating two sets of worms and gears 152, 153 for raising two pulleys 162, 163 and raising two crank shafts 142*a*, 143*a* of two end arcuate jacks 142, 143 formed on opposite ends of the frame 400. Each crank shaft 142*a* or 143*a* will be lifted as guided by a pair of rollers 211, 212 pivotally mounted on an upper opening of each sleeve 142*b* or 143*b* by the jack 142 or 143. Two wires 192, 193 are respectively wound on the two pulleys 162, 163, each wire having its one end secured to a bottom of each crank shaft 142*a* or 143*a* and having the other end of the wire secured to the frame 400, so that upon the rising of the pulleys 162, 163, the crank shafts 142*a*, 143*a* will be pulled upwardly. Each crank shaft 143*a* or 142*a* is provided with two supporting and pivoting rollers 201 in a top opening of the shaft so that upon a rising of the shaft, a port 221 defined by the two rollers 201 will be engaged with a central hook portion 1*h* of each suspending telescopic rod means 1*a* or 1*b* which is secured to a head portion or feet portion of the bed 200 as shown in FIG. 3 so as to lift the top and feet portions of the bed 200 as shown in FIG. 9 for forming a concave bed for lying or sleeping purpose. An electromagnetic latch 12 still locks the central portion of the bed 200 and two pivotal joints 51, 52 are provided for upwardly moving the two end portions of the bed 200. Two armrests 81, 82 are also raised for resting a user's arms. After finishing the positioning of the concave bed, the power will be automatically switched off.

Figure 5:
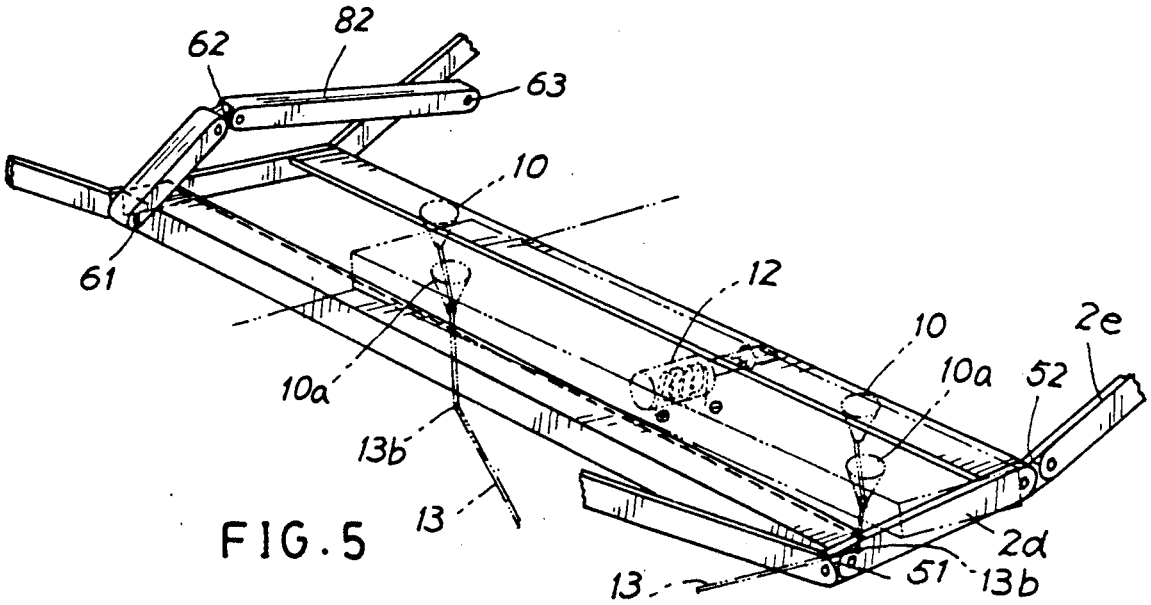
FIG. 5 shows a locking or unlocking mechanism of the bed on the bed frame of the present invention.
Figure 10:
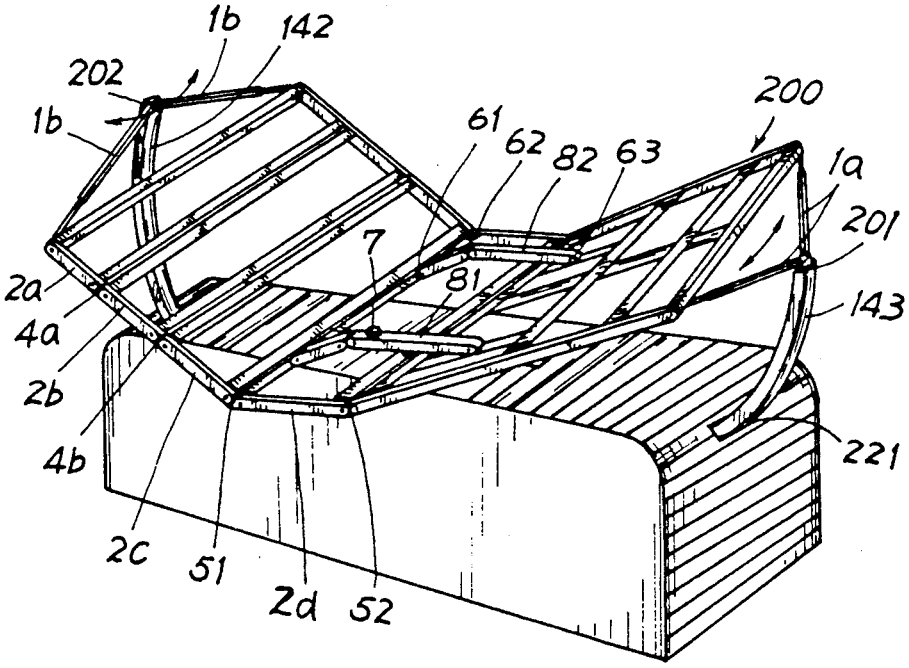
FIG. 10 shows a hammock in accordance with the present invention.

If for forming a hammock as shown in FIG. 10, the button 7 is shifted to a marking of "hammock" to continuously operate the present invention from the concave bed as shown in FIG. 9. The signal transmitted to the clutch controller 33 will continuously lift the two jacks 142, 143 and the electromagnetic latch 12 is unlocked to separate the bed 200 from the housing 39 and a recovery line 13 is loosened by uncoupling a clutch 28 of the recovery line as shown in FIG. 5 for a free rotation of a winding reel 30 which is provided to rewind the recovery line 13. A cam shaft 27 is rotated as driven by the driving motor 25 by means of a transmission belt 31 as shown in FIG. 1, 1*a* to oscillate a cycloid line 26 secured between the bed 200 and the cam shaft 27 so as to shake the "hammock" bed 200 as shown in FIG. 10 for comforting a user lying on the bed.

For returning the hammock bed to a flat bed, the switch button is actuated on the marking of "flat bed" to flatten the bed, wherein the clutch controller 29 of clutch 28 is acted to rotate the winding reel 30 for rewinding the recovery line 13 backward onto the reel 30 to recover the bed 200 downwardly to lay down on the frame 400. The loosening or recovery of the line 13 as shown in FIG. 5 is like flying a kite. When the latch 12 is actuated to unlock the bed 200 from housing 39, a plug 10 securing the line 13 to a bed bottom is raised to disengage from a plug holder (socket) 10*a* formed in the housing 39 since the line 13 is no longer tightenend by the winding real 30, allowing a free shaking operation of the hammock bed driven by the cam shaft 27 and cycloid line 26. After recovering the line 13 by the winding reel 30, the plug 10 is received into socket 10*a*, and the latch 12 is actuated to lock the bed 200 with housing 39 for stabilizing the bed.

The present invention can provide multiple functions, such as for serving a flat bed, a folding chair, a reclining bed, a concave bed, or a hammock for diversified uses to be superior to any conventional bed of single function and use.

Figure 2:
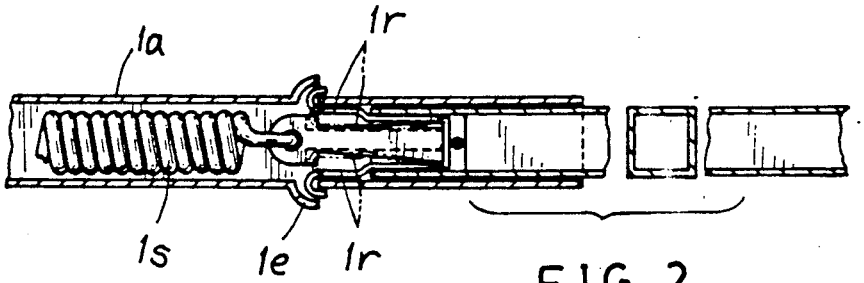
FIG. 2 shows a telescopic rod means for suspending a hammock in accordance with the present invention.

The suspending telescopic rod 1*a* as shown in FIG. 2 includes an inner pipe telescopically received in an outer pipe, both inner and outer pipes being tensioned by a spring 1*s* and being gravitationally stretched to allow a spring retainer 1*r* of the inner pipe to engage an enlarged portion 1*e* formed on an opening of the outer pipe when a user lies on the bed. The inner or outer pipes are preferably made with polygonal cross section for preventing any axial rotation of the pipes for ensuring the engagement between the hook portion 1*h* with the two rollers 201.

Although an electrical control circuit is provided in this invention to automatically switch off the motor running, there may still be provided with several limit switches or safety. stoppers for limiting a reciprocating or moving operation of any moving element of the present invention.

For smoothly running each of the three jack shafts 141*a*, 142*a*, 143*a*, a pair of rollers 213*a*, 212*a*, 211*a* are formed on each shaft to be slidably contacted with each sleeve 141*b*, 142*b*, 143*b*. All shafts 141*a*, 142*a*, 143*a* are automatically recovered to their lower position as restored by each restoring spring (not shown) normally retained on a bottom portion of each sleeve.

I claim:

1. A variable bed comprising:

a foldable bed including a plurality of bed units pivotally joined with one another to be operatively folded or flattened;

a lifting means including a central arcuate jack for operatively raising a bed unit of the foldable bed corresponding to a user's back portion for forming a folding chair, and two end arcuate jacks for operatively raising two opposite end portions of the foldable bed for forming a concave bed having the two end portions of the foldable bed corresponding to a user's head and feet portions raised upwardly with respect to a lower central portion of the bed; a driving means for driving the plurality of jacks and for moving the foldable bed; and a bed frame for movably mounting the driving means therein, and for mounting said foldable bed on said frame, said foldable bed being operatively rolled upon said frame while driven by said driving means.

2. A variable bed according to claim 1, wherein said foldable bed is provided with a plurality of rollers on a bottom of each bed unit to be operatively rolled on said bed frame.

3. A variable bed according to claim 1, wherein said bed is formed with two sets of armrests each said armrest including a parallelogram linkage pivotally connected on a central bed unit of the foldable bed.

4. A variable bed according to claim 3 wherein said central arcuate jack includes a first crank shaft movably held in a first jack sleeve, and a first wire secured between a bottom portion of said first crank shaft and a housing of the driving means, said first wire wound on a first pulley driven by a first worm and gear driven by a driving motor of the driving means through a first clutch which is controlled by a first clutch controller by actuating a switch button formed on one said armrest of the foldable bed; and each said end acurate jack includes a second crank shaft movably held in a second jack sleeve formed on a front or a rear end of said bed frame, and a second wire secured between a bottom portion of said second crank shaft and said bed frame, said second wire wound on a second pulley which is driven by a telescopic transmission shaft driven by said driving motor of said driving means through a second clutch which is controlled by a second clutch controller by actuating said switch button formed on said armrest;

5. A variable bed according to claim 1, wherein said bed includes two sets of suspending telescopic rods formed on two end portions of the bed corresponding to a user's head and feet portions, each set of suspending telescopic rod having a central hook portion operatively engaged with a port defined between two supporting and pivoting rollers pivotally formed in an upper opening of each crank shaft of each said end arcuate jack for suspending the bed on the two end arcuate jacks.

6. A variable bed according to claim 1, wherein said driving means includes at least a forwarding wheel operatively rolled on a rail formed on a bottom in the bed frame and driven by the driving motor for moving the central jack for forwarding the back portion of the foldable bed frontwardly to allow at least a front bed unit to be pendant on a front end wall of the bed frame for forming an upstanding folding chair.

7. A variable bed according to claim 1, wherein said foldable bed is provided with an electromagnetic latch for normally locking said bed on a housing of the driving means.

8. A variable bed according to claim 1, wherein at least a recovery line is secured between a bottom portion of the foldable bed and a winding reel, and is operatively loosened when raising the bed by uncoupling the winding real and is operatively rewound on the winding reel for recovering the recovery line when flattening the raised bed.

9. A variable bed according to claim 1, wherein a cycloid line is secured between the bed and a cam shaft driven by the driving means for operatively shaking the bed to be a shaking hammock while raised by the two end arcuate jacks.

10. A variable bed according to claim 1, wherein a foldable louver is slidably held in a guide groove formed in the bed frame for operatively shielding the bed frame and the driving means.

* * * * *